US009179209B2

(12) United States Patent
Emilsson

(10) Patent No.: US 9,179,209 B2
(45) Date of Patent: Nov. 3, 2015

(54) ARM FOR SUPPORTING A SENSOR

(75) Inventor: Niklas D. B. Emilsson, Rydaholm (SE)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 632 days.

(21) Appl. No.: 13/148,693

(22) PCT Filed: Feb. 15, 2010

(86) PCT No.: PCT/US2010/024215
§ 371 (c)(1),
(2), (4) Date: Aug. 10, 2011

(87) PCT Pub. No.: WO2010/096354
PCT Pub. Date: Aug. 26, 2010

(65) Prior Publication Data

US 2011/0308517 A1 Dec. 22, 2011

(30) Foreign Application Priority Data

Feb. 20, 2009 (EP) ..... 09153300

(51) Int. Cl.
*A62B 18/08* (2006.01)
*H04R 1/08* (2006.01)
*A42B 3/30* (2006.01)

(52) U.S. Cl.
CPC *H04R 1/083* (2013.01); *A42B 3/30* (2013.01); *A62B 18/08* (2013.01); *H04R 2201/107* (2013.01)

(58) Field of Classification Search
None
See application file for complete search history.

(56) References Cited

U.S. PATENT DOCUMENTS 2,814,293 A * 11/1957 Gabb et al. ..... 128/206.27
2,879,343 A * 3/1959 Finken ..... 379/430
3,314,424 A * 4/1967 Berman ..... 128/201.19
3,347,229 A * 10/1967 Heitman ..... 128/201.19
4,720,857 A * 1/1988 Burris et al. ..... 379/430
4,889,303 A 12/1989 Wolf
5,259,373 A * 11/1993 Gruenke et al. ..... 128/204.23
5,504,813 A * 4/1996 Takasaki ..... 379/433.13
5,574,794 A * 11/1996 Valley ..... 381/361

(Continued)

FOREIGN PATENT DOCUMENTS

CN 1259840 7/2000
DE 1032104 B 6/1958

(Continued)

OTHER PUBLICATIONS

International Application No. PCT/US2010/024215 Search Report dated Jun. 1, 2010.

*Primary Examiner* — Lynne Anderson
*Assistant Examiner* — Eric Bryant
(74) *Attorney, Agent, or Firm* — Melanie G. Gover; Emily M. Van Vliet

(57) ABSTRACT

A sensor support arm, adapted for use with a breathing mask such that the arm is extendable underneath a sealing surface of a breathing mask is disclosed. The arm is adaptable at one end for fixing on to equipment worn by a user, having a sensor disposed at an opposing end positionable in the interior of a breathing mask. The arm has lead connections necessary for the sensor extending along the arm. The arm has a greater width than thickness and comprises a flexible material such that it is flexible about both longitudinal and transverse axes. The arm is provided with a substantially planar side. A breathing mask having a freely self-supporting sensor arm is also disclosed.

15 Claims, 4 Drawing Sheets

(56) References Cited

U.S. PATENT DOCUMENTS

| | | | | |
|---|---|---|---|---|
| 5,771,886 | A * | 6/1998 | Maire et al. | 128/207.11 |
| 6,101,402 | A * | 8/2000 | Bartha et al. | 455/569.1 |
| 6,236,969 | B1 * | 5/2001 | Ruppert et al. | 704/275 |
| 6,886,559 | B2 * | 5/2005 | McDonald et al. | 128/201.24 |
| 7,234,462 | B2 * | 6/2007 | Palazzotto et al. | 128/201.19 |
| 7,937,117 | B2 | 5/2011 | Dyer | |
| 2002/0056457 | A1 * | 5/2002 | Demers et al. | 128/206.27 |
| 2005/0105285 | A1 * | 5/2005 | Maden | 362/105 |
| 2005/0105740 | A1 | 5/2005 | Dyer | |
| 2007/0049837 | A1 * | 3/2007 | Shertukde et al. | 600/528 |
| 2008/0092898 | A1 * | 4/2008 | Schneider et al. | 128/206.28 |

FOREIGN PATENT DOCUMENTS

| | | | |
|---|---|---|---|
| DE | 1083662 | | 6/1960 |
| DE | 102007006732 | A1 | 8/2008 |
| EP | 1484087 | A1 | 12/2004 |
| GB | 862136 | A | 3/1961 |
| WO | WO 98/08358 | | 2/1998 |

* cited by examiner

ARM FOR SUPPORTING A SENSOR

This application is a national stage filing under 35 U.S.C. 371 of PCT/US2010/024215, filed Feb. 15, 2010, which claims priority to European Application No. 09153300.0, filed Feb. 20, 2009, the disclosure of which is incorporated by reference in its/their entirety herein.

TECHNICAL FIELD

The present invention relates to an arm for supporting a sensor, preferably a microphone, where the arm is provided, at one end, with an anchorage for fixing on to equipment worn by a user, for example, a hearing protector, and where the sensor is disposed at the opposing end of the arm.

BACKGROUND ART

The use of breathing masks is prevalent in many different fields, both military and civilian, such as in aeronautics, rescue services, diving, in different types of industrial environments where hazardous products are used, etc. Despite the use of a breathing mask, there are still requirements on two-way communication, for which reason the person wearing the breathing mask must be able, via communication equipment, to communicate with someone in the ambient surroundings.

Often, breathing masks are combined with other types of equipment, for example, personal (safety) equipment, such as hearing protectors, safety helmets or the like. In such cases, it is normal that the safety equipment is provided with a microphone boom which is located in the region of the user's mouth and can thereby receive sound signals. However, such a solution cannot, as a rule, be used together with a breathing mask, since the microphone will be located on the outside of the breathing mask, where the possibility to receive sound is impaired. The relationship will be the same if the personal equipment consists of a headset.

It is previously known in the art to position a microphone interiorly in a breathing mask. See, for example DE 1 083 662 (B). This document shows a full mask, which, in the material of the mask, has leads embedded which, on the inside of the mask, may be connected via a terminal to a microphone positioned inside the mask. On the outside of the mask, there is a corresponding terminal, to which may be connected a suitable lead to some form of communication equipment.

A breathing mask of this type can not be used easily in combination with any other type of safety equipment, where a microphone is already integrated.

Further, there is naturally a certain risk of leakage in the passages which are required for it to be possible to lead out the electric signals of the microphone to the outside of the breathing mask and there be connected to communication equipment.

DE 10 2007 006 732 A1 discloses a breathing mask in which a microphone is disposed. According to this publication, there are no through-passages for electric leads, but the microphone signals are transmitted in wireless mode via radio to a receiver on the outside of the breathing mask.

EP 1 484 087 A1 shows a breathing mask where a conductor or conduit runs from the inside of the breathing mask to the outside of the mask. The conductor or conduit is provided on the outside of the breathing mask with an accommodation space in which a microphone may sealingly be slid into position, the microphone being disposed on a microphone boom which in its turn is mounted on some form of safety equipment. Naturally, there are also leakage risks in this case.

Further, the possibility of freely combining a breathing mask with optional personal (safety) equipment is extremely limited.

It is therefore desirable to provide an arm for supporting a sensor that may be secured on to personal (safety) equipment such as a headset, strapping, hearing protector, safety helmet etc., such that it can be used alone or in combination with a breathing mask without risk of leakage.

The present invention aims to address the above problem by providing a sensor support arm, adapted for use with a breathing mask such that the arm is extendable underneath a sealing surface of a breathing mask and adaptable at one end for fixing on to equipment worn by a user, having a sensor disposed at an opposing end positionable in the interior of a breathing mask, and having lead connections necessary for the sensor extending along the arm, the arm having a greater width than thickness and comprising a flexible material such that it is flexible about both longitudinal and transverse axes, wherein the arm is provided with a substantially planar side.

By providing a sensor support arm that has a greater width than thickness, that is at least flexible about both longitudinal and transverse axes, and has a substantially planar side that can seal against the sealing surface of the mask, the arm can be used alone or in combination with a breathing mask without risk of leakage. Furthermore the lead connections necessary for the sensor extend along the arm such that they do not contribute to the risk of mask leakage.

Preferably, an arm where the substantially planar side of the arm is turned to face towards the sealing surface. Preferably, an arm that includes an arched side and more preferably, where the arched side has tapering edge portions.

Preferably, an arm that is strip shaped and/or where the width is greater than fives times its thickness. An arm that includes a flexible material that is yieldable and elastic. An arm where the sensor comprises a microphone and/or where the end adaptable for fixing to the equipment is arranged to allow pivotal adjustment of the arm.

Preferably, an arm that is provided with coating that realises adhesion and/or an arm that is freely self-supporting.

The present invention aims to provide a breathing mask having sealing surfaces formed to seal around the nose and mouth of a wearer, comprising a freely self-supporting sensor support arm that extends under a sealing surface of the breathing mask and is adaptable, at one end, for fixing on to equipment worn by a user and has a sensor disposed at an opposing end positionable in the interior of the breathing mask, with lead connections necessary for the sensor extending along the arm, the arm having a greater width than thickness and comprising a flexible material such that is flexible about both longitudinal and transverse axes, wherein the arm is provided with a substantially planar side.

Preferably. a breathing mask where the arm includes an arched side and more preferably, where the arched side has tapering edge portions.

Preferably, a breathing mask where, in use, the substantially planar side of the arm is turned to face towards a sealing surface of the mask. A breathing mask where the arm includes a flexible material that is yieldable and elastic and/or where the end of the arm adaptable for fixing to the equipment is arranged to allow pivotal adjustment of the arm.

Preferably, a breathing mask where the arm is provided with coating that realises adhesion.

BRIEF DESCRIPTION OF THE ACCOMPANYING DRAWINGS

By way of example only, an embodiment of the present invention will now be described in greater detail hereinbelow, with reference to the accompanying drawings. In the accompanying drawings.

DESCRIPTION OF PREFERRED EMBODIMENT

An embodiment of the present invention will be described hereinbelow as applied to a hearing protector, but it will be obvious to the skilled reader of this specification that it may just as well be applied to any optional personal (safety) equipment, such as a headset, a safety helmet, strapping for optional purposes, etc.

The present disclosure also has for its object to design the arm intimated by way of introduction so that it will be simple and economical in manufacture and robust in use.

Figure 1:
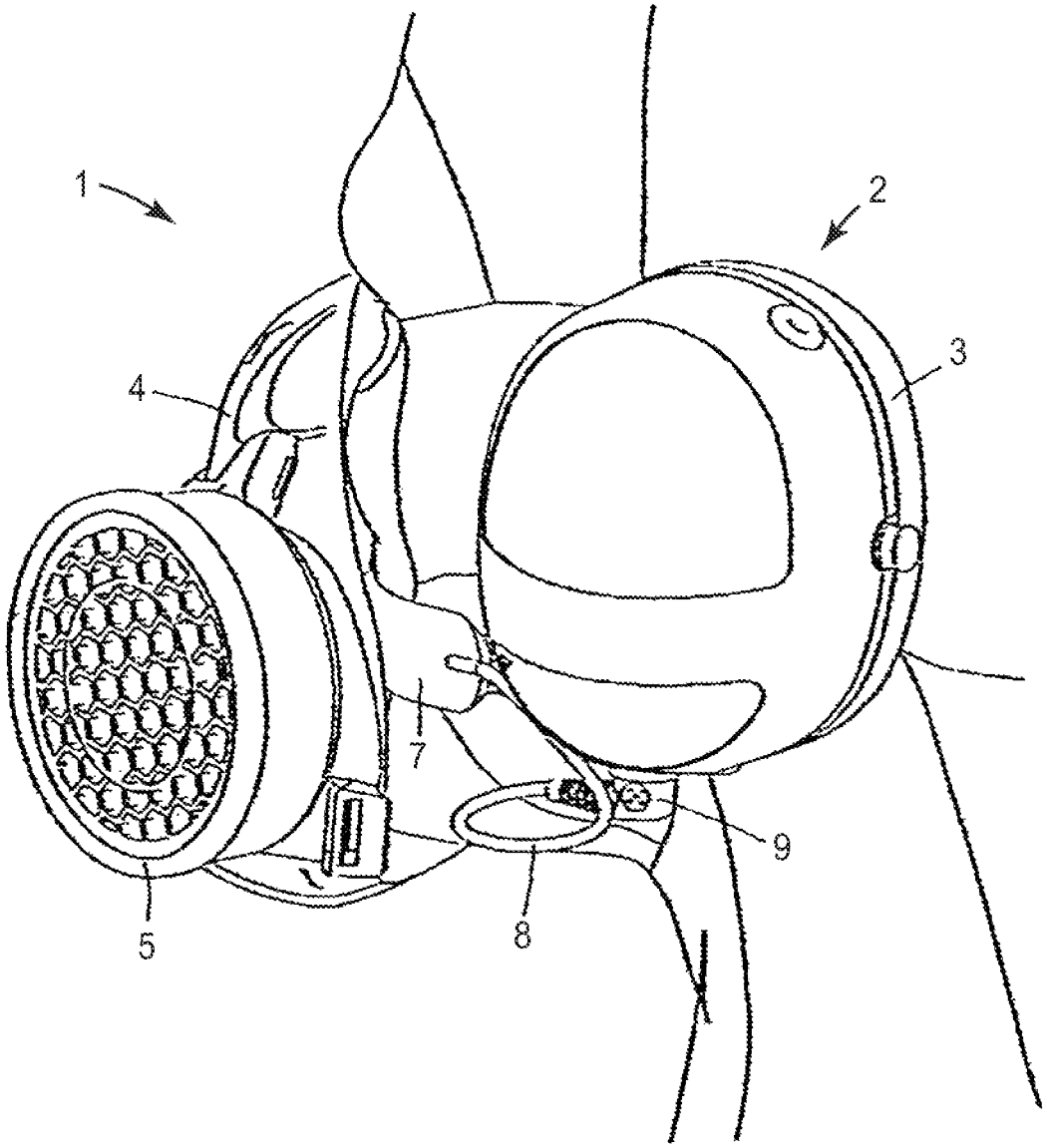
FIG. 1 is a perspective view of a person wearing both a breathing mask and hearing protector.

FIG. 1 shows in perspective from the side a part of the head of a person wearing a breathing mask 1 and a hearing protector 2. For the sake of simplicity, certain parts have been omitted, such as the crown strap of the hearing protector 2, its hood fixings and strapping relating to the breathing mask. The hearing protector 2 is of the type which has two hoods 3 with integrated communication equipment, inter alia, including a loudspeaker disposed interiorly in the hood.

The breathing mask 1 has an outer casing 4 on which at least one filter 5 is disposed and through which the wearer of the breathing mask breathes. As an alternative to a filter, it is also possible to provide the breathing mask with supply lines for a suitable breathing gas.

Figure 2:
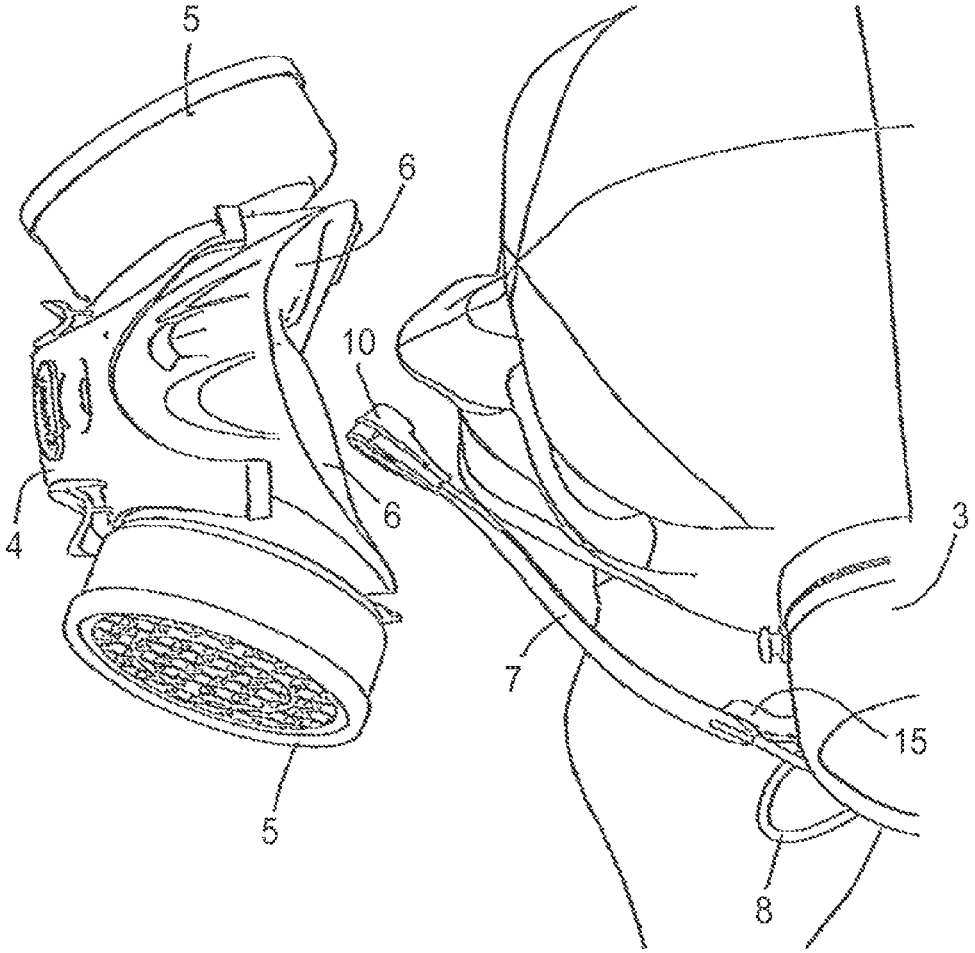
FIG. 2 shows the person according to FIG. 1 seen more from above, the breathing mask having been lifted away from the nose/mouth of the wearer.

It will be apparent from FIG. 2 that the breathing mask, in addition to the outer casing 4, has inner surfaces functioning as sealing surfaces 6, which are soft and resilient and which are formed to seal around the mouth and nose of the wearer of the breathing mask. In such instance, these sealing surfaces are so resilient that they can adapt in shape to the face of the wearer readily and with completely tight sealing abutment.

It will be apparent from FIG. 1 that there is an arm 7 secured on the hood, the arm having a lead or conductor 8 which is provided with a suitable terminal 9 which connects the lead 8 to some suitable communication equipment. In the illustrated case the lead 8 connects to the communication equipment of the hood 3.

The arm 7 extends to the interior of the breathing mask 1 and has a sensor 10 which, in the embodiment illustrated here, is a microphone for taking up sound. Examples of other sensors that may be used include temperature, pressure or gas sensors for the metering or establishing a physical or organic magnitudes, for example temperature or the composition of breathing gases, breathing rate, etc.

The arm 7 is manufactured from a flexible, somewhat resilient and possibly elastic material, for example a rubber or plastic quality which however may not be so flimsy that the arm droops down under its own weight. The material in the arm 7 or a reinforcing or rigidifying means disposed therein is thus sufficiently rigid for the arm to be freely self-supporting in an extended state, that is when the arm is unloaded and extended to it's fullest extent, and thus be reliably able to be positioned in the region in front of or at the side of the wearer of the hearing protector. Further, the material in the arm is so resilient that the arm can be bent at least somewhat both about longitudinal and about transverse bending axes.

Figure 4:
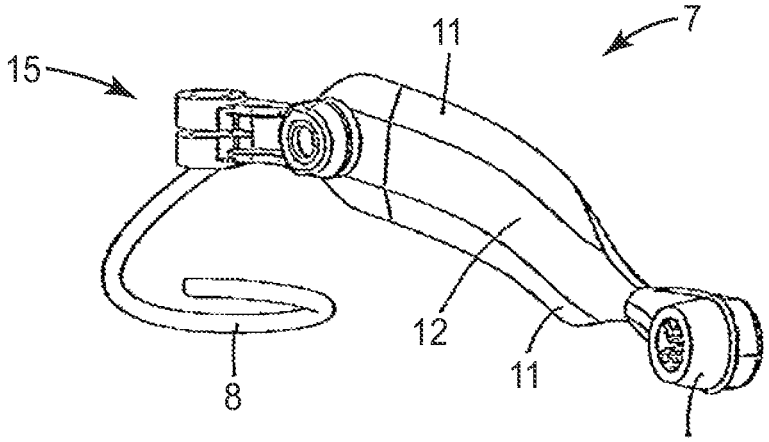
FIG. 4 is a perspective view of the arm according to the present invention.
Figure 5:
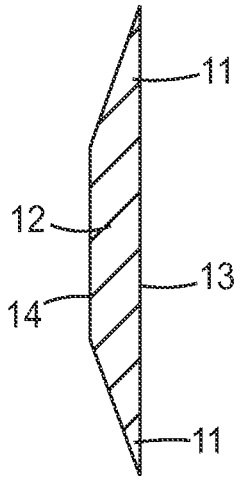
FIG. 5 is a cross section through the arm illustrated in FIG. 4.

The arm 7 is, as is best apparent from FIGS. 4 and 5, strip-shaped with a "flat" cross section and has a considerably greater width than thickness. Preferably, its width, that is from top to bottom in FIG. 5, is at least five times its thickness, that is from the left-hand side to the right-hand side in FIG. 5, but it may be ten times greater than its thickness. The exact proportions between width and thickness are immaterial, as long as the arm does not cause such major deformations, in particular sudden transitions, in the sealing surfaces 6 and the skin of the wearer of the breathing mask such that the sealing tightness capabilities are jeopardised.

If the material in the arm consists of a plastic or rubber material, this may be given directed properties by a suitably formed reinforcement, for example a textile reinforcement. In certain cases, in particular if the plastic or the rubber material in the arm is very soft, it may be appropriate to embed a flexible and possibly resilient metal reinforcement in the cross section of the arm. In such instance, it is important however that such a reinforcement must not extend appreciably outside the outer contour of the cross section. In addition, the flexibility of the arm should not be overly affected, since both the arm and its cross section must to some degree be able to be bent in order to be able to follow the contours of the skin of the wearer of the breathing mask.

In order to improve the seal against both the skin and the sealing surfaces 6 of the breathing mask, the surface of the arm 7 may be provided with coating which realises adhesion, which is tacky or which is very soft, for example a soft silicon or rubber material.

It will be clearly apparent from FIG. 5 that the cross section of the arm is not of uniform thickness but that it has tapering edge portions 11 along opposing longitudinal sides, where the material thickness in a direction from the central region 12 of the arm out towards the opposing edges tapers to nothing or to a very slight thickness. In the unloaded state of the arm, the tapering edge portions may be triangular, but may also have an arcuate surface, in which event the arching possibly extends in over the central region 12 so that the left-hand side of the cross section in FIG. 5 will be convex. The convex side may therefore, for example be defined by an arc of a circle, an arc of an ellipse, etc.

The arm 7 has one side 13 which, in the unloaded state of the arm, is substantially planar, that is generally flat, but which, by mechanical action, may be arched about both longitudinal and transverse axes. On use of the arm, this substantially planar side 13 faces away from the skin of the user of the arm. This implies that the substantially planar side 13 will be turned to face towards the sealing surfaces 6 of the breathing mask 1 when the arm, as is apparent from FIG. 1, extends in under the breathing mask so that the microphone 10 of the arm will be located interiorly, that is in the interior of the mask. It has been proven that the skin of the wearer is as a rule so resilient that it can tightly close around and seal against the arched side of the arm while the sealing surfaces 6 of the breathing mask more readily seal against the substantially planar side 13.

It has also proved to be important that the microphone 10 is mechanically disconnected from (contact free) the outer casing 4 of the breathing mask since otherwise the outer casing would be able to transmit external noise to the microphone 10.

In FIG. 5, it is further shown that the "arched or convex" side of the arm is provided with a film 14 which has on its surface or internally electric leads for electric connection of the microphone 10 to the communication equipment of the hood 3. Wired leads may also be employed and be embedded in the material of the arm 7.

It will be apparent from FIG. 4 that the end of the arm facing away from the microphone 10, has an anchorage 15 for securing the arm on the hood 3 of the hearing protector 2. However, the anchorage 15 may also be designed to secure the arm on some other type of equipment, for example strapping or webbing, a safety helmet, a visor or some similar type of equipment.

Figure 3:
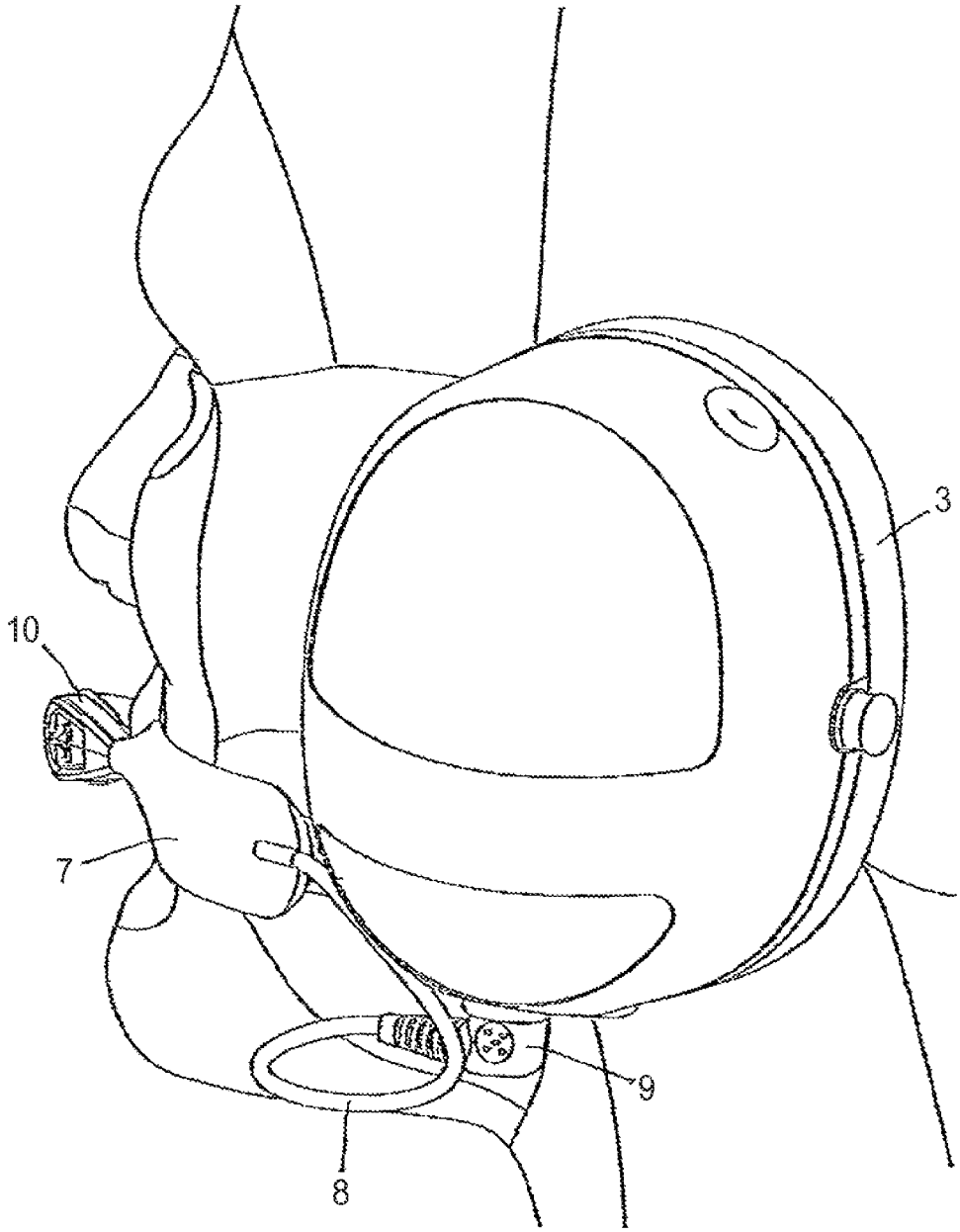
FIG. 3 shows the person according to FIGS. 1 and 2, now completely divested of breathing mask.

The anchorage 15 is formed in such a manner that it offers adjustment possibilities (pivotal) of the arm 7 about at least two different axes. In the embodiment illustrated here, these axes lie at right angles in relation to one another. This adjustment possibility could, for example in FIG. 3, entail that the arm 7 may be pivoted in the vertical direction so that the microphone 10 is raised or lowered. The pivoting about the second axis implies that the arm in its entirety can be swivelled out sideways or more or less inwards in front of the mouth of the wearer.

What is claimed is:

1. A sensor support arm, adapted for use with a breathing mask, such that the sensor support arm is adapted to extend underneath a sealing surface of the breathing mask and is adapted to be fixed at one end, exterior to the breathing mask, on to equipment worn by a user, having a sensor disposed at an opposing end adapted to be positioned in an interior of the breathing mask, and having lead connections for the sensor extending along the sensor support arm, the sensor support arm having a greater width than thickness and comprising a material that is flexible about both longitudinal and transverse axes of the sensor support arm, wherein the sensor support arm is provided with a substantially planar side;

wherein the substantially planar side of the sensor support arm is adapted to be turned to face towards the sealing surface;

wherein the equipment worn by the user is adapted to be used alone or in combination with the breathing mask, and wherein, on use of the sensor support arm, the substantially planar side faces away from the user of the sensor support arm.

2. The sensor support arm of claim 1, wherein the sensor support arm further comprises an arched side having tapering edge portions.

3. The sensor support arm of claim 1, wherein the sensor support arm is strip shaped.

4. The sensor support arm of claim 1, wherein the flexible material is yieldable and elastic.

5. The sensor support arm of claim 1, wherein the width of the sensor support arm is greater than five times its thickness.

6. The sensor support arm of claim 1, wherein the sensor comprises a microphone.

7. The sensor support arm of claim 1, wherein the end of the sensor support arm adaptable for fixing to the equipment worn by the user is arranged to allow pivotal adjustment of the sensor support arm.

8. The sensor support arm of claim 1, wherein the sensor support arm is provided with coating that realizes adhesion.

9. The sensor support arm of claim 1, wherein the sensor support arm is freely self-supporting.

10. A breathing mask having sealing surfaces adapted to form a seal around a nose and mouth of a user, comprising a sensor support arm adapted to extend under the sealing surface of the breathing mask and is adapted to be fixed at one end, exterior to the breathing mask, on to equipment worn by the user and has a sensor disposed at an opposing end adapted to be positioned in an interior of the breathing mask, with lead connections for the sensor extending along the sensor support arm, the sensor support arm having a greater width than thickness and comprising a material that is flexible about both longitudinal and transverse axes of the sensor support arm, wherein the sensor support arm is provided with a substantially planar side; wherein, in use, the substantially planar side of the sensor support arm is adapted to be turned to face towards the sealing surface of the breathing mask; wherein the equipment worn by the user is adapted to be used alone or in combination with the breathing mask, and wherein, on use of the sensor support arm, the substantially planar side faces away from the user of the sensor support arm.

11. The breathing mask of claim 10, wherein the sensor support arm includes an arched side.

12. The breathing mask of claim 11, wherein the arched side has tapering edge portions.

13. The breathing mask of claim 12, wherein the flexible material is yieldable and elastic.

14. The breathing mask of claim 13, wherein the end of the sensor support arm adaptable for fixing to the equipment is arranged to allow pivotal adjustment of the sensor support arm.

15. The breathing mask of claim 14, wherein the sensor support arm is provided with coating that realizes adhesion.

* * * * *